US008627520B1

(12) United States Patent
Morton

(10) Patent No.: US 8,627,520 B1
(45) Date of Patent: Jan. 14, 2014

(54) PORTABLE INFANT BED

(76) Inventor: Farah D. Morton, Franklin, TN (US)

( * ) Notice: Subject to any disclaimer, the term of this patent is extended or adjusted under 35 U.S.C. 154(b) by 0 days.

(21) Appl. No.: 13/457,171

(22) Filed: Apr. 26, 2012

(51) Int. Cl.
*A47D 7/00* (2006.01)
*A47D 13/02* (2006.01)

(52) U.S. Cl.
USPC ..... 5/99.1; 5/655; 190/2

(58) Field of Classification Search
USPC ..... 5/98.1, 99.1, 655; 190/2; 383/4
See application file for complete search history.

(56) References Cited

U.S. PATENT DOCUMENTS 2,502,486 A * 4/1950 Savrin ..... 190/1
3,492,680 A * 2/1970 Coolidge ..... 5/99.1
4,198,718 A * 4/1980 Ballard ..... 5/93.2
4,999,863 A * 3/1991 Kane ..... 5/98.1
6,370,715 B1 * 4/2002 Morton ..... 5/655
7,404,219 B2 * 7/2008 Berkey ..... 5/98.1
7,444,694 B2 * 11/2008 Brewin et al. ..... 5/94

* cited by examiner

*Primary Examiner* — Michael Trettel
(74) *Attorney, Agent, or Firm* — Howard Cohen

(57) ABSTRACT

An infant bed construction includes an outer fabric cover having longitudinally opposed rounded end portions joined by a generally rectangular medial portion. The cover includes an oval bottom assembly and a continuous sidewall extending upwardly from the perimeter of the bottom assembly. A pair of end frames are removably secured in the end portions of the bed. Each end frame includes an upstanding sidewall having a generally semi-cylindrical shape, with a base panel spanning the lower edges of the sidewall in contiguous fashion. A center frame panel is interposed between the two base panels in the bottom assembly. The fabric cover has end pockets to secure the end frame. The sidewalls of the medial portion of the bed include a layer of breathable structural material that is form-retaining yet bendable. The bed folds for transport by bringing together the two end portions, in clamshell fashion.

22 Claims, 4 Drawing Sheets

PORTABLE INFANT BED

CROSS-REFERENCE TO RELATED APPLICATIONS

Not applicable.

FEDERALLY SPONSORED RESEARCH

Not applicable.

SEQUENCE LISTING, ETC ON CD

Not applicable.

BACKGROUND OF THE INVENTION

1. Field of the Invention

This invention relates to an infant bed and, more particularly, to an infant bed that is structurally reinforced to protect the infant and is foldable for easy portability.

2. Description of Related Art

It is well known that newborn human infants require a great deal of sleep. The most common sleeping place for newborns and small infants during the first few months of life is in a bassinet. Then, as the infant grows and becomes too large for the bassinet, it is typically moved to a crib. Most newborn infants are unable to raise their heads for a number of days or weeks after birth, and most are unable to roll themselves over for several weeks or months. Because of the limited mobility of most newborns, the bassinet where they sleep is typically provided with a firm and flat mattress pad and no pillow in order to help prevent inadvertent suffocation of the infant. A tall peripheral wall around the bassinet prevents the infant from falling out. Unfortunately, these features make the bassinet bulky and difficult to transport.

It is typical for parents of newborn infants to keep the bassinet in the adult bedroom at night. This facilitates easy access to the infant during the night for feeding, changing or other needs that the infant may have. However, the unpredictable and seemingly unceasing demands of newborn infants can take their toll on the new parents and deprive them of much-needed sleep at night. Often, the warm and soothing touch of the parents is all that is necessary to help the infant fall asleep. Unfortunately, it can be both awkward and uncomfortable to lean over or reach into the bassinet in order to comfort the infant, especially when the tired parent would much rather be lying down. It is therefore desirable to provide an infant bed that can be easily accessed by the parent while lying down.

This arrangement, termed "co-sleeping", involves the use of an infant bed that is adapted to support and protect an infant when sleeping in the adult bed. This arrangement may be not only desired, but necessary, by mothers who are recovering from labor and delivery, and/or from Caesarian section births. Likewise, nursing babies may be fed at night with minimal disruption of the sleep of the nursing mother.

One exemplary design is described in U.S. Pat. No. 6,370,715, issued to Farah Morton on Apr. 16, 2002, now Reissue RE 40,754 of Jun. 23, 2009. It is directed toward a portable infant bed having a base panel, and an end wall and two side walls surrounding contiguous edges of the base panel to protect the infant from hazards such as choking, suffocating, or rollover injuries. The present invention is viewed as providing significant improvements over that patented invention.

BRIEF SUMMARY OF THE INVENTION

The present invention generally comprises an infant bed construction that not only provides a snug and secure place for the infant, but also protects the infant when sleeping, and may be used in the same bed as the parent or other adult. The infant bed is also easily folded to a compact form for easy portability and may be used for other sleeping situations. The infant bed includes an outer fabric cover defining a longitudinally extending flexible body, with longitudinally opposed end portions joined by a generally rectangular medial portion. The end portions may be semi-cylindrical, oval, faceted, or rectilinear. The cover includes an oval bottom panel and a continuous sidewall extending upwardly from the perimeter of the bottom panel.

A salient feature of the bed is the provision of structural frame members to reinforce the sidewall, including a pair of end frames removably secured in the end portions of the bed. Each end frame includes an upstanding sidewall having a shape that circumscribes approximately 180°, such as a oval or rectilinear shape or a generally semi-cylindrical shape, with a base panel spanning the lower edges of the frame sidewall in contiguous fashion. The end frame base panel includes a plurality of channels extending laterally therein to stiffen the panel, and a plurality of holes to lighten the mass and provide air flow.

The fabric cover at the end portions of the bed includes inner and outer end panels that define an end pocket in each end portion, and each end frame is dimensioned and configured to be received in one of the end pockets. The curved sidewall of each end frame extends concentrically within the inner and outer panels of the respective rounded end portion of the outer cover, and the base panel of each end frame extends in a bottom end pocket formed between the upper and lower panels of the end portions of the bottom of the bed. Thus the sidewalls of the end portions are reinforced to withstand the weight of incident items such as pillows or blankets and protect the infant sleeping in the bed.

The structural frame assembly further includes a center frame panel secured in a medial pocket formed between the upper and lower panels of the bottom of the bed, between the opposed end portions. The center frame panel generally fills the space in the bottom assembly between the end portions, and it has longitudinally opposed ends that are disposed in adjacent, confronting relationship to the inboard ends of the end frame base panels. The center frame panel and the end frames are joined in assembly by the cover assembly, and the adjacent confronting edges of the end frame base panels and the center frame panel define hinge zones that extend laterally in the bed.

The sidewalls of the medial portion of the bed are formed of a multilayer fabric assembly that may optionally include a layer of breathable structural material that is form-retaining yet bendable. The bottom of the medial portion of the bed is likewise formed of a multilayer fabric assembly, and is also bendable. As a result, the bed may be folded along the lateral hinge zones for transport by bringing together the two end portions, in clamshell fashion, and securing them together in abutting relationship using an included strap assembly.

The infant bed further includes a mattress having an elongated longitudinal shape that is configured to be removably received within the sidewalls of the bed in a snug fit. The mattress is form-retaining, soft, and foldable, and it may remain within the bed when it is folded into the compact transport configuration.

The interior sidewall of the fabric cover may optionally be provided with a band of breathable mesh material that extends continuously about the interior sidewall and joins to the bottom panel. The mesh material, together with the breathable structural material of the medial sidewalls, enables complete breathability for an infant in the middle of the bed. At the end portions, the walls of the end frames are provided with slot cutouts that admit air and likewise provide complete breathability.

DETAILED DESCRIPTION OF THE INVENTION

Figure 1A:
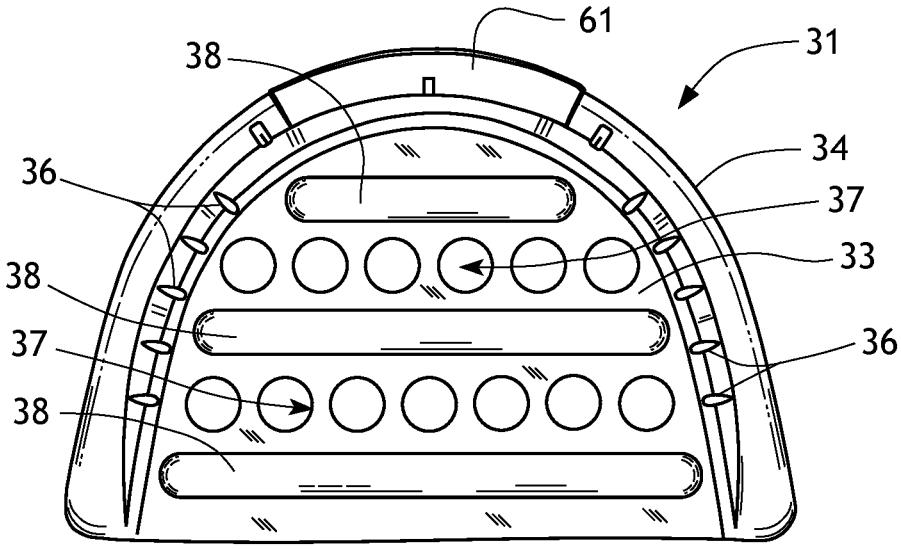
FIG. 1A is a plan view of an end frame structural member of the infant bed of the invention.
Figure 1B:
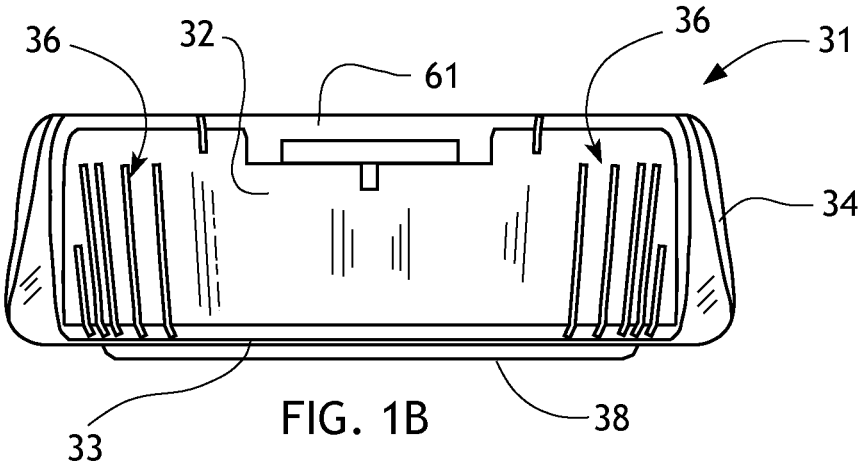
FIG. 1B is a proximal end elevation of the end frame structural member.
Figure 2:
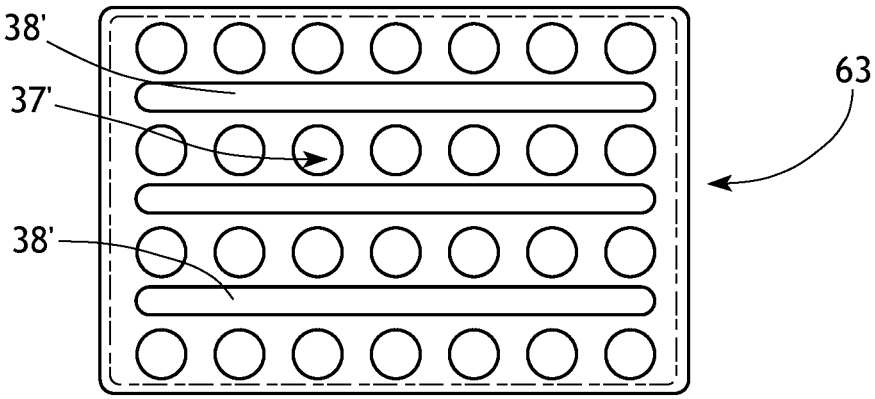
FIG. 2 is a plan view of the center frame panel of the infant bed of the invention.
Figure 3:
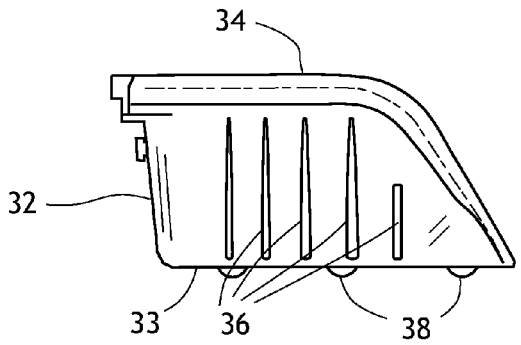
FIGS. 3 and 4 are side elevations of the end frame structural member of FIGS. 1 and 2, and an alternate embodiment thereof, respectively.
Figure 4:
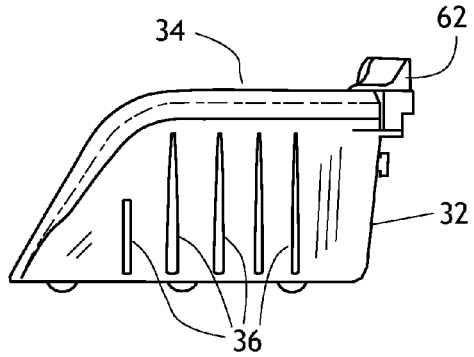

The present invention generally comprises an infant bed construction that not only provides a snug and secure place for the infant, but also protects the infant when sleeping, and may be used, for example, in the same bed as the parent or other adult. With regard to the accompanying Figures, and in particular FIGS. 5-8, the infant bed 20 is generally comprised of an outer cover 21 formed of a soft, sturdy fabric, the cover 21 having a longitudinal shape that may comprise any convenient closed curved shape, such as a rectangular, cylindrical or oval configuration. The cover 21 includes a bottom panel assembly 22 having the designated closed curved configuration and a continuous sidewall 23 extending upwardly from the perimeter of the bottom panel assembly 22. The sidewall 23 and bottom panel assembly 22 together define an enclosure for an infant in the form of an upwardly opening coffer that contains and protects the infant. A mattress 24 having the same elongated, flat closed curved shape is configured to be removably received within the sidewall 23 of the bed in a snug fit. The mattress 24 is form-retaining, soft, and foldable, providing a compliant surface for the infant and also providing thermal insulation against heat loss to the horizontal surface supporting the infant bed.

The infant bed 20 includes sidewall end portions 26 and 26' that are longitudinally opposed ends of the bed, and may be semi-cylindrical, rectilinear, oval, faceted, or any similar arrangement that enable the sidewall end portions to describe approximately 180° end closure. The sidewall end portions 26 and 26' are also provided with structural frame members to reinforce those end portions of the sidewall and add greater strength to the sidewall. With regard to FIGS. 1-4 in particular, the structural frame members include a pair of end frames 31 having very similar size and shape. Each end frame 31 includes a sidewall 32 that describes an excursion of approximately 180°, such as a rectangular relationship, a semi-cylinder or semi-oval, or a faceted arrangement, so that it defines a closed end as shown. The sidewall shown is a generally semi-cylindrical shape, and a base panel 33 spans the lower edge of the sidewall 32 in contiguous, integral fashion. The free upper edge of the sidewall 32 is provided with a rolled edge 34 (see FIG. 8 also) that augments the strength and stiffness of the sidewall 32. The end frame sidewall 32 is also provided with an array of slot cutouts 36 extending generally transversely to the plane of the base panel which permit airflow through the sidewall without compromising its stiffness or strength. The base panel 33 is provided with multiple holes 37 arranged in linear arrays that are aligned with the lateral extent of the base panel 33. A plurality of rounded channels 38 are formed integrally in the base panel 33 and also aligned laterally, preferably interspersed with the linear arrays of holes 37. The holes 37 reduce the mass of the frame and provide airflow through the base panel, and the channels 38 add substantial stiffness to the base panel 33.

The outer cover 21 at the semi-circular sidewall portions 26 and 26' of longitudinally opposed ends of the bed is provided with a pair of pockets 46 and 46', each configured and dimensioned to receive and secure one of the end frames 31 in an enclosure that is complementary to the shape of the end frame. Inner and outer fabric pieces 47 and 48 form the semi-cylindrical sidewall portion 26, with the pocket 46 formed therebetween to receive the sidewall 32 of an end frame 31. In addition, the pocket 46 continues between multiply layers of the cover bottom assembly 22 and is terminated by the seam 51 in the bottom assembly (see FIG. 5). A zipper 52 or similar closure is provided in the outer fabric piece 48, subtending a substantial solid angle of the semi-cylindrical end shape, to enable the installation and removal of the end frame 31 for shipping or cleaning purposes. (The sidewall portion 26' is similarly constructed, and similar components are accorded the same reference numerals with a prime (') designation.)

Figure 5:
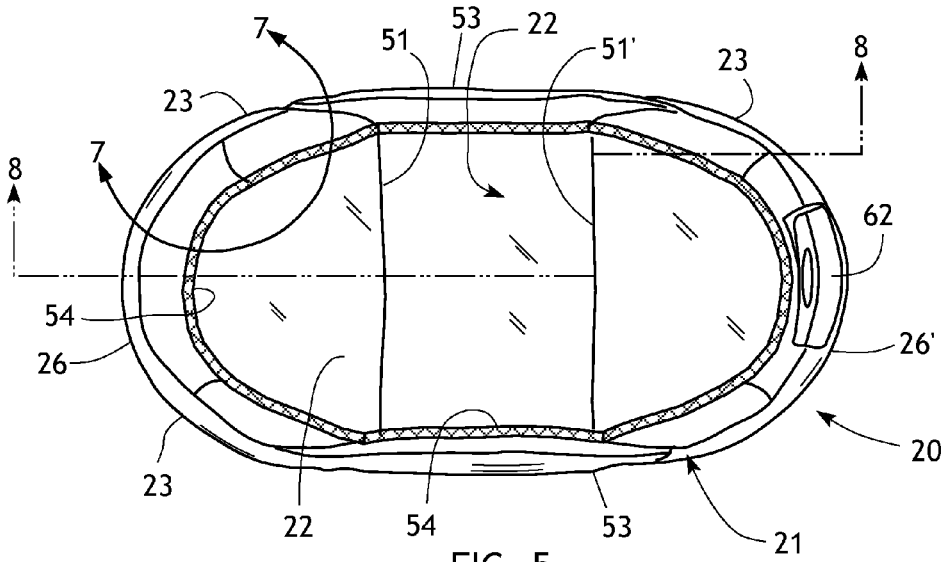
FIG. 5 is a plan layout of the infant bed of the invention, shown in the open position with the mattress removed.
Figure 6:
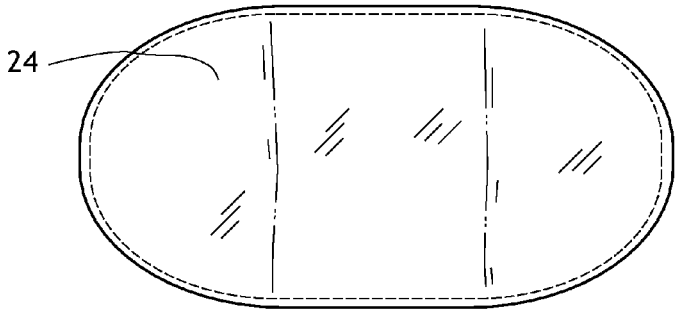
FIG. 6 is a plan view of the mattress of the infant bed of the invention.
Figure 7:
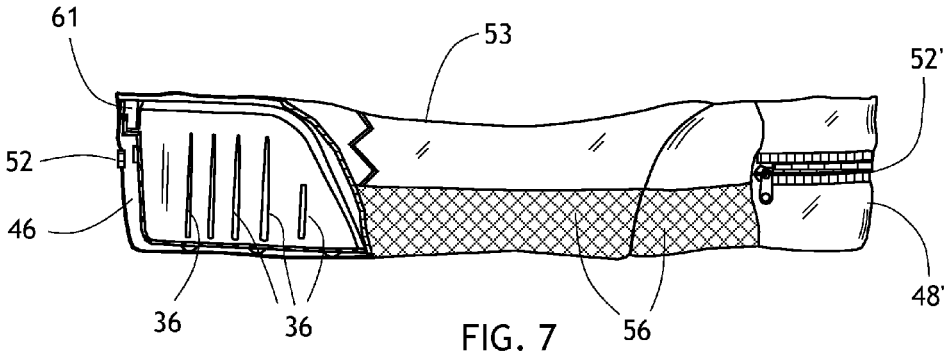
FIG. 7 is a partially cross-sectioned side elevation of the infant bed, taken along line 7-7 of FIG. 5.
Figure 8:
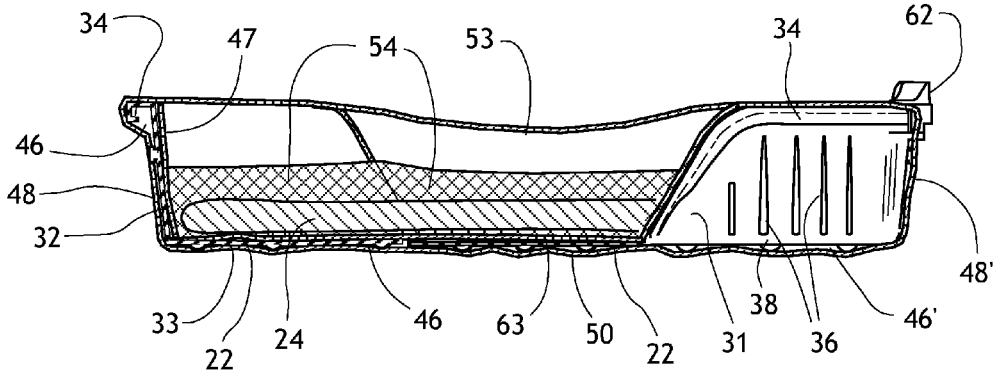
FIG. 8 is a cross-sectioned side elevation of the infant bed with the mattress in place, taken along line 8-8 of FIG. 5.

With further regard to FIG. 5, the seams 51 and 51' in the bottom assembly further define a medial pocket 50 that spans the space between the bottom portions of pockets 46. The structural frame members further include a center frame panel 63 removable secured in the medial pocket 50. The center frame panel is formed of a stiff, resilient material, and includes' multiple holes 37' arranged in linear arrays that are aligned with the lateral extent of the base panel 63. A plurality of rounded channels 38' are formed integrally in the base panel 33 and also aligned laterally, preferably interspersed with the linear arrays of holes 37, similar to the arrangement in the end frame base panels 33. The holes 37' likewise reduce the mass of the frame and provide airflow through the base panel, and the channels 38' add substantial stiffness to the panel 63.

The center frame panel 63 generally fills the space in the bottom assembly between the end portions, and it has longitudinally opposed ends that are disposed in adjacent, confronting relationship to the inboard ends of the end frame base panels 33. The center frame panel and the end frames are joined in assembly by the cover assembly, so that the panel 63 and end frame bottom panels 33 are disposed generally in a coplanar relationship. Thus the mattress 24 is well-supported throughout its length. The adjacent confronting edges of the end frame base panels 33 and the center frame panel 63 define hinge zones that extend laterally in the bed generally along seam lines 51 and 51'.

The medial portions 53 of the sidewall 23 of the bed 20 extend in generally parallel relationship to each other and extend between the end portions 26 and 26'. The medial portions 53 may be formed of a multilayer fabric assembly, and may optionally include an inner core layer of breathable structural material that is form-retaining and soft yet bendable. In addition, an optional band 54 of open mesh fabric forms the lower inside extents of the medial portions 53 as well as the end portions 26 and 26' of the sidewall. Likewise, a optional band 56 of open mesh fabric forms the lower outer extents of medial portions 53 of the sidewall, and further overlaps to form segments of the end portions 26 and 26'. The combined effect of the mesh fabric bands 54 and 56 and the breathable structural material and the slot openings 36 is that there is no impediment to airflow through the sidewall of the bed, and an infant sleeping in the bed cannot possibly asphyxiate or smother, no matter what position the infant occupies in the bed.

Figure 9:
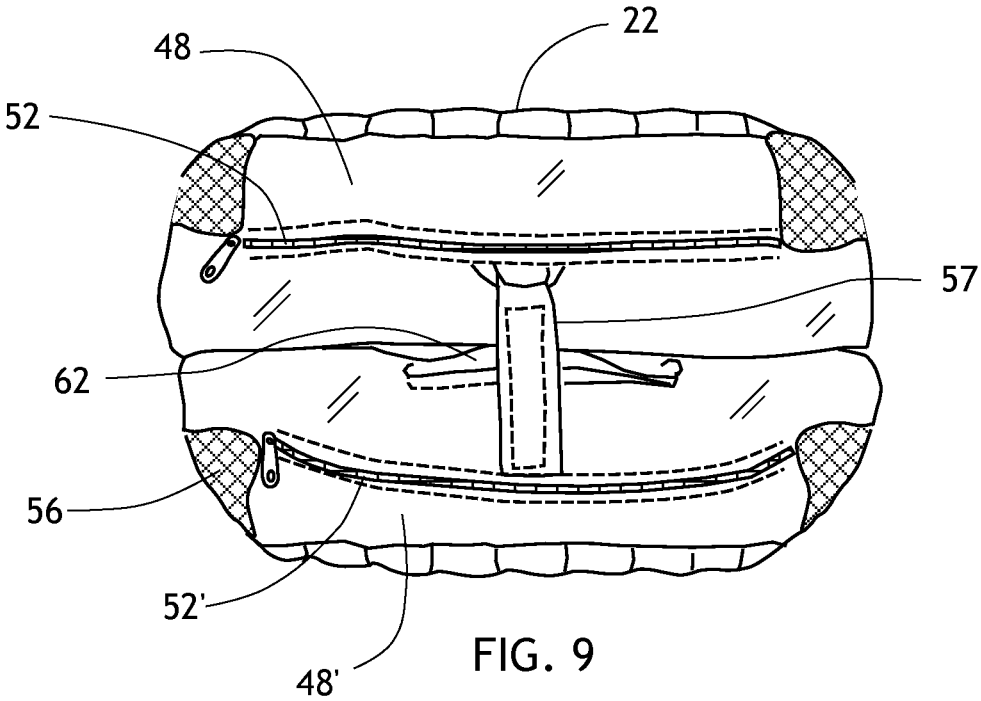
FIGS. 9 and 10 are an end view and a side view of the infant bed in the folded configuration.
Figure 10:
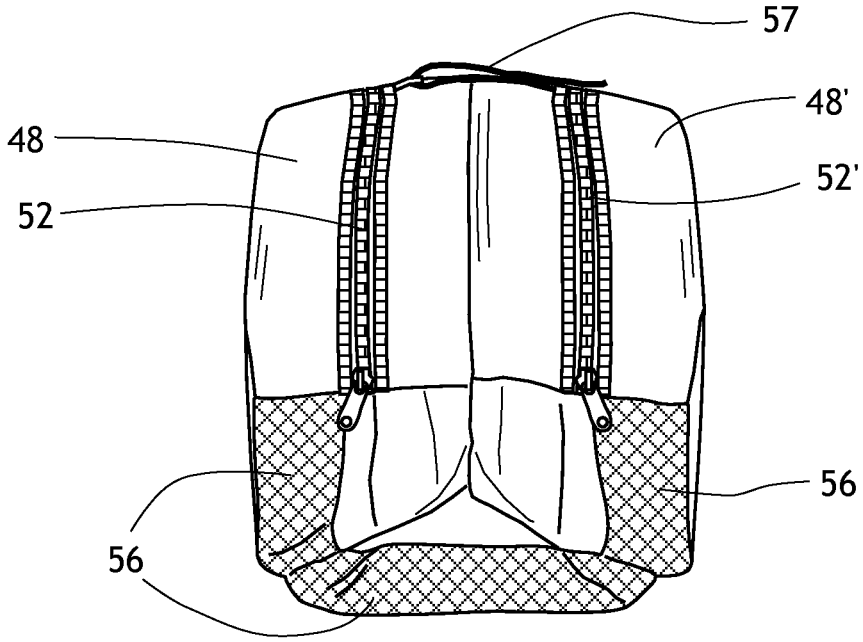

The bottom of the medial portion of the bed is likewise formed of a multilayer fabric assembly, and is also bendable. As a result, the bed may be folded along the lateral hinge zones at seams 51 and 51' for transport by bringing together the two end portions 26 and 26', in clamshell fashion, and securing them together in abutting relationship using an included strap assembly 57, as shown in FIGS. 9 and 10. Thus the bed may be transformed into a compact shape that enables easy transport or storage, and the bed may be deployed by the merest action of releasing the strap 57 and unfolding the bed until it is fully open and horizontal. Note that the dimensions of the bed 20 are approximately 24 inches long and 14 inches wide and 4-6 inches deep. Given the fact that the average newborn is approximately 14-20 inches in length, the size of the bed 20 virtually requires the infant to sleep lengthwise in the bed while discouraging the infant from moving to a position that is crosswise to the longitudinal axis of the bed. Thus the structurally reinforced end portions necessarily protect the head of the infant and provide a safe sleep environment for the vulnerable child.

An optional feature of the bed is the provision of a sound generating module 62 to create music, nature sounds, or other soothing audio programming to encourage an infant to fall asleep while resting in the bed. The end frames 31 may be provided with a socket recess 61 formed in the upper edge 34 thereof in a marquee position, the sound module 62 being configured to snap-engage in the recess 61 in removable fashion and extend outwardly through a suitably placed opening in the outer cover.

In the preceding explanation of the infant bed, where specific materials are not otherwise called forth cloth that forms the outer cover may comprise a quilted fabric treatment that is soft to the touch and pleasant to the eye. Moreover, the components enumerated above may be separate units or may be integrally formed, in accordance with efficient manufacturing practices and the overriding concerns of comfort and safety for the infant sleeping in the bed.

It may be appreciated that the infant bed 20 may be used in a wide variety of situations and places, due to the support and protections provided by the structural frame components, as well as the soft materials used and the breathability of the assembly.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A portable infant bed, including:

a cover formed of a soft fabric and having a bottom assembly with a medial portion and a pair of end portions extending from said medial portion in longitudinally opposed fashion;

said cover including a sidewall projecting upwardly from the perimeter of said bottom assembly and extending continuously about said perimeter to enclose an infant resting on said bottom assembly, said sidewall having sidewall medial portions extending upwardly from said medial portion of said bottom assembly and opposed sidewall end portions extending upwardly from said end portions of said bottom assembly;

a plurality of structural frame members secured in said sidewall end portions to protect an infant resting on said bottom assembly, wherein each of said structural frame members includes a frame sidewall extending in a generally curved configuration and a frame base panel spanning a lower edge of said frame sidewall.

2. The portable infant bed of claim 1, wherein each of said sidewall end portions includes a pocket configured in complementary fashion to receive said curved frame sidewall.

3. The portable infant bed of claim 2, wherein each of said pockets includes a bottom portion extending in said bottom assembly, said bottom portion configured in complementary fashion to receive said frame base panel.

4. The portable infant bed of claim 3, further including a closable opening in each of said pockets for installing and removing said structural frame member.

5. A portable infant bed, including:

a cover formed of a soft fabric and having a bottom assembly a medial portion and a pair of end portions extending from said medial portion in longitudinally opposed fashion;

said cover including a sidewall projecting upwardly from the perimeter of said bottom assembly and extending continuously about said perimeter to enclose an infant resting on said bottom assembly, said sidewall having sidewall medial portions extending upwardly from said medial portion of said bottom assembly and opposed sidewall end portions extending upwardly from said end portions of said bottom assembly;

a plurality of structural frame members secured in said sidewall end portions to protect an infant resting on said bottom assembly, wherein said medial portion of said bottom assembly includes a medial pocket for housing a generally flat center frame panel interposed between said frame base panels of said structural frame members.

6. The portable infant bed of claim 5, wherein said bottom portion is foldable along lateral hinge zones aligned between said center frame panel and said frame base panels, whereby said bed may be reconfigured to a portable condition in which said sidewall end portions are disposed in confronting impingement in clamshell fashion.

7. A portable infant bed, including:

a cover formed of a soft fabric and having a bottom assembly with a medial portion and a pair of end portions extending from said medial portion in longitudinally opposed fashion;

said cover including a sidewall projecting upwardly from the perimeter of said bottom assembly and extending continuously about said perimeter to enclose an infant resting on said bottom assembly, said sidewall having sidewall medial portions extending upwardly from said medial portion of said bottom assembly and opposed sidewall end portions extending upwardly from said end portions of said bottom assembly;

a plurality of structural frame members secured in said sidewall end portions to protect an infant resting on said bottom assembly, wherein said sidewall includes an interior surface, and further including a first band of breathable mesh fabric extending about said interior surface of said sidewall in continuous fashion, said first band of breathable mesh fabric having a lower continuous edge joined to said bottom panel assembly.

8. The portable infant bed of claim 7, wherein said sidewall includes an exterior surface, and further including a second band of breathable mesh fabric extending about said exterior surface of said medial portion of said sidewall, said second band of breathable mesh fabric having a lower continuous edge joined to said bottom panel assembly.

9. The portable infant bed of claim 8, wherein said first and second bands of breathable mesh fabric are disposed in generally parallel relationship, said medial sidewall portion further including a breathable structural material that is form-retaining and bendable, said breathable structural material being sandwiched between said first and second bands of breathable mesh fabric.

10. The portable infant bed of claim 9, wherein said second band of breathable mesh fabric extends to parts of said sidewall portions.

11. The portable infant bed of claim 1, wherein said frame sidewall includes a plurality of slot openings extending therein to permit airflow therethrough.

12. The portable infant bed of claim 1, wherein said base panel includes at least one channel-like depression integrally formed therein to enhance stiffness of said base panel and frame sidewall.

13. The portable infant bed of claim 12, wherein said base panel includes a plurality of holes formed therein in linear array to permit airflow through said base panel.

14. The portable infant bed of claim 13, wherein said linear array of holes in said base panel is generally parallel to said at least one channel-like depression.

15. The portable infant bed of claim 14, wherein said frame sidewall includes an upper extent opposed to said lower edge, said upper extent having a rolled edge to enhance stiffness of the sidewall and present a soft rim.

16. The portable infant bed of claim 1, further including a mattress pad dimensioned and configured to rest on an interior surface of said bottom assembly and be received within said sidewall in a snug fit.

17. The portable infant bed of claim 5, wherein said sidewall end portions are generally semi-cylindrical, and said center frame panel is generally rectangular.

18. A portable infant bed, including:

a structural frame arrangement comprised of a pair of end frames and a center frame panel, each end frame having a frame sidewall extending upwardly from a frame base panel in a curved fashion to define a closed end;

said center frame panel extending in a plane generally aligned with said frame base panels and disposed in adjacent relationship between said frame base panels;

a cover formed of a soft fabric and shaped to conform to said frame base panels and center frame panel and to join said frame base panels and center frame panel in an operative assembly.

19. The portable infant bed of claim 18, wherein said cover is foldable along hinge zones aligned between said center frame panel and said frame base panels, whereby said bed may be reconfigured to a portable condition in which said sidewall end portions are disposed in confronting impingement in clamshell fashion.

20. The portable infant bed of claim 18, wherein said frame sidewall comprises a planar web that is curved in an excursion of approximately 180° to define said closed end.

21. The portable infant bed of claim 18, wherein said cover includes a bottom assembly having pocket portions adapted to secure said frame base panels and said center frame panel.

22. The portable infant bed of claim 21, wherein said cover includes a sidewall assembly extending from said bottom assembly and having pocket portions for securing said frame sidewalls of said end frames.

* * * * *